US005215010A

United States Patent [19]

Johnson

[11] Patent Number: 5,215,010

[45] Date of Patent: Jun. 1, 1993

[54] FREE-RANGING BI-DIRECTIONAL SHOP PRESS

[76] Inventor: Jerome A. Johnson, 1509 W. 2nd Ave., Gary, Ind. 46402

[21] Appl. No.: 849,892

[22] Filed: Mar. 13, 1992

[51] Int. Cl.[5] ..... B30B 1/32

[52] U.S. Cl. ..... 100/266; 100/214

[58] Field of Search ..... 100/214, 266, 264

[56] References Cited

U.S. PATENT DOCUMENTS

| | | | |
|---|---|---|---|
| 2,267,662 | 12/1941 | Miller | 100/266 |
| 2,387,839 | 10/1945 | Frost | 100/266 |
| 2,742,853 | 4/1956 | Knelson | 100/266 X |
| 3,229,619 | 1/1966 | Van Dranen | 100/266 X |
| 3,283,699 | 11/1966 | Hawkins | 100/266 X |
| 3,495,527 | 2/1970 | Lafreniere | 100/266 X |

*Primary Examiner*—Stephen F. Gerrity

[57] ABSTRACT

The free ranging press allows a hydraulic jack to exert a workforce pressure simultaneously in two directions, by dividing the force and then recombining the force. By positioning the jack between a crossbeam of the movable press frame and the movable press platen both the jack rod and jack housing are capable of moving in concert to thereby reclaim profitable workforce pressure.

7 Claims, 1 Drawing Sheet

FREE-RANGING BI-DIRECTIONAL SHOP PRESS

TECHNICAL FIELD

This invention relates to new and useful improvements in the art of press operations, seeking to advance the art; through the workforce process.

BACKGROUND ART

In conventional shop-type presses, the desired work is achieved when pressure is applied to a workpiece (in one direction); when positioned between two inert and opposing points of a given frame. Potential workforce pressure, equivalent to actual workforce pressure; is lost to this system on one end.

SUMMARY OF THE INVENTION

The objective of this invention, is to introduce a concept for maximizing the workforce through a recovery process (heretofore unknown to have been addressed). This system permits equal workforce usage to be gleaned from both ends of a hydraulic jack simultaneously; utilizing hydraulic capacity heretofore lost to inert resistance.

BEST MODE FOR CARRYING OUT THE INVENTION

Figure 1:
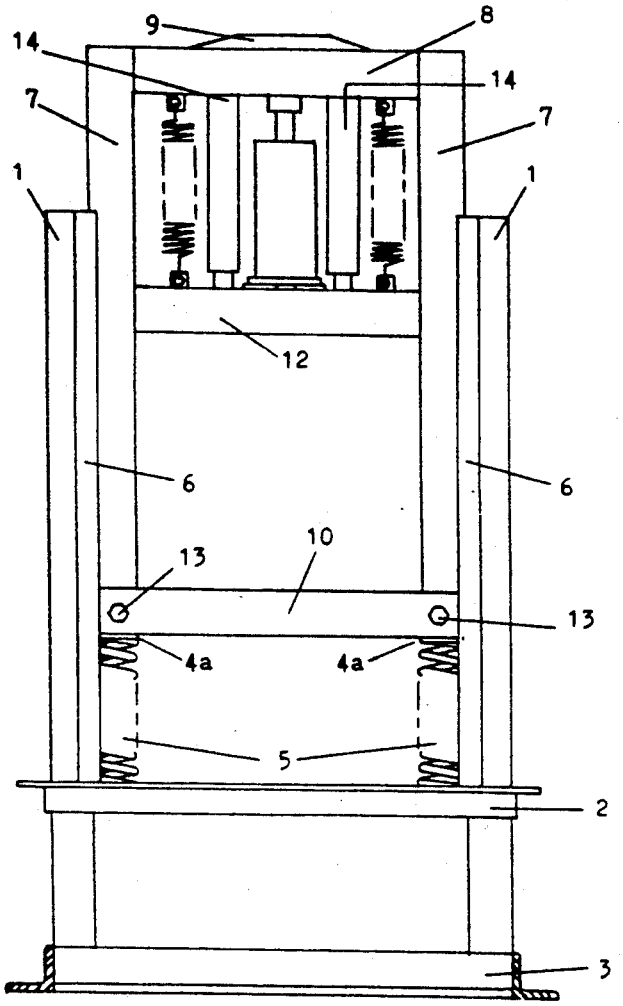
FIG. 1 represents a front elevational view of the press.
Figure 2:
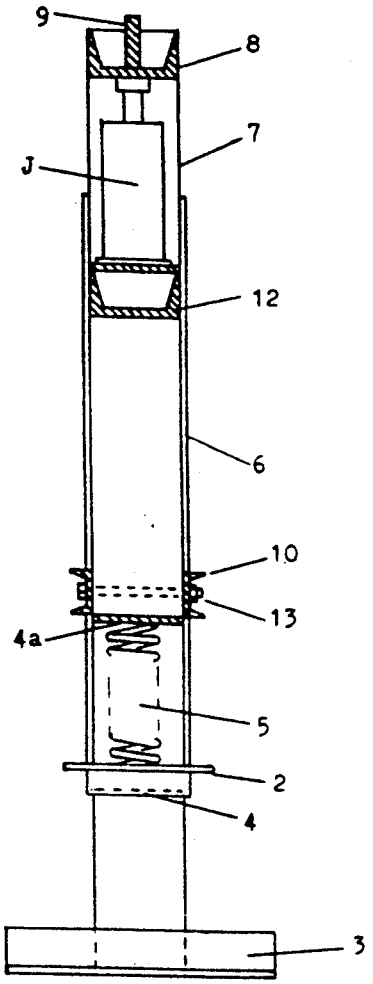
FIG. 2 represents a vertical section of the press carriage (in the press stand).
Figure 3:
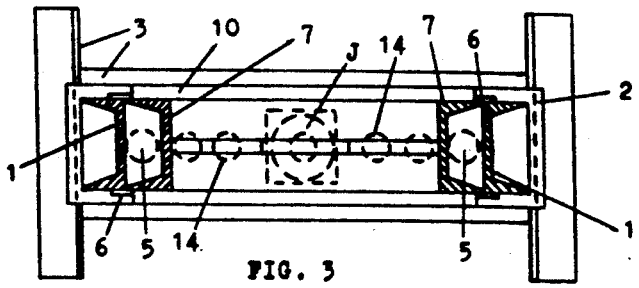
FIG. 3 is an overhead view.
Figure 4:
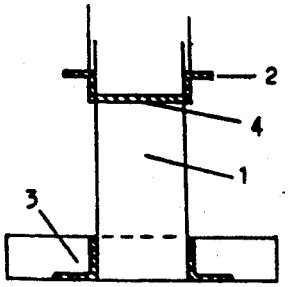
FIG. 4 is a fragmentary vertical section of the press stand (lower spring support).

Proceeding now to describe my invention in detail, it will be seen upon referring to the accompanying drawings; that it first comprises a vertically constructed framework collectively designated the Press Stand. Said framework includes a pair of vertically disposed side members (1) of structural channel, with the flanges thereof facing outward. Said members (1) are spanned and encompassed around on all sides, below the median of its length with a crossmember of 90° angle (2). The base of the structure is comprised of an angle of somewhat greater dimension (3) and elongated on the sides thereof to provide a base and secure the paralleling of said members (1).

Within said member (2) and buttressing said members (1) are, fixed by welds, two flat steel plates (4); of sufficient dimension, rigidity and thickness to support the two workrest/load springs (5). Said springs (5) are of a sufficient design to bear in suspension, the workrest frame and a variety of workpieces. Attached to the webs of said members (1), on all sides and extending upwards, from atop said member (2) to the top of said members (1); are four flat steel members (6). Said members (6) are also positioned so as to extend their width slightly inwards beyond the webs of said members (1), thereby creating a guide avenue; for vertical reciprocation of the workrest frame.

The Workrest Frame (WF), comprises a pair of vertically disposed members of like channel (7); as said members (1) with the flanges thereof facing outward. Said members (7) are disposed in width apart, nominally less in distance than said members (1); so as to slide disposedly vertical therein, in close tolerance. Said members (7), are spanned between the tops thereof; with the press head crossmember (8) fixed. Said member (8) is comprised of like channel, with the flanges thereof facing upwards and reinforced across the top thereof; with a rib of flat steel (9) welded on edge, across the expanse of said member (8) and buttressing the webs of said members (7).

Ridgidly disposed at the base thereof with bolts (13), to ensure uniformity of the workrest frame; said members (7) are spanned on either side with channel (10) to establish the work rest table. Said members (10) are measured to span the distance between said members (6); but nominally less the distance thereof, so as to allow tolerance of vertical movement therein. Said members (7) and said member (8) being fixedly combined with said members (10) in rigid attendance; slide disposedly in vertical reciprocation within said member (PS) in the work process. It is hereon to be understood, that said members (7), said member (8) and said members (10) (in rigid relation); are combined to form a single unitized part. Welded to the underside of the now (WF), covering the ends of said members (7); are fixed two steel plates (4*a*). Relative in dimension and disposed in parallel to said members (4), said plates (4*a*) support said unit (WF) in suspended relation to said (PS); atop said members (5): thereby facilitating the desired action of this invention.

The Press Plate (12), being comprised of channel is measured to span the distance between said members (7); horizontally: but nominally less the distance thereof, so as to facilitate ease of vertical movement. Said member (12) is positioned with the flanges thereof directed upwards, so as to provide extra strength; during the downward work stroke. Said member (12) is held in relation to said (WF), with two return springs (15); sufficient to retain said (12) and the jack securely in the rest mode. Said member (12) is retained in the vertical of the work stroke with said return springs (15) disposed congruent; to either side of the jack means (J).

While the foregoing specification sets forth the invention in specific terms, it is to be understood that numerous changes in shape, size and material may be resorted to without departure from the spirit and scope of the invention as claimed hereinafter.

I claim:

1. A shop press for applying a bi-directional work force comprising:

a press stand and a reciprocatable workrest frame;

said press stand comprising:

a base member having a top surface;

a first and second upright frame members each having a bottom surface;

said first and second upright frame members each being mounted at said bottom surface to said base member and perpendicularly extending therefrom in spaced apart parallel relationship;

a guide means mounted to said first and second upright frame members for guiding said reciprocatable workrest frame relative to said press stand;

said reciprocatable workrest frame comprising:

a lower support means having a bottom surface and a first and second side surfaces slidably engaging said guide means;

a first and second upright side members each having a top end, a bottom end and a side surface for slidably engaging said guide means;

said first and second upright side members each being mounted at said bottom end to said lower support means by mounting means and each said side member perpendicularly extending form said lower support means in spaced apart parallel relationship to one another and parallel to said upright frame members;

an upper support means perpendicularly connected to each of said upright side members at the top end thereof;

a reciprocating means connected to said upper support means;

a platen extending between said upright side members and guided thereby and connected to said reciprocating means for reciprocation along said upright side members and relative to said lower support means;

a first and second biassing springs connected between said platen and said upper support means for biassing said platen towards said upper support means; and a first and second support springs each having a first end and a second end, and each support spring being connected to said bottom surface of said lower support means at said first end of said support spring and connected to said top surface of said base member at said second end of said support spring, whereby said reciprocatable workrest frame is supported by said support springs for reciprocating movement relative to said press stand.

2. The shop press of claim 1, wherein said reciprocating means is a manually operated jack.

3. The shop press of claim 1, wherein said lower support means comprises first and second lower support members.

4. The shop press of claim 3, wherein said mounting means includes bolts for mounting said first and second upright side members to said first and second lower support members.

5. The shop press of claim 1, wherein the first upright side member has a first plate attached thereto and the second upright side member has a second plate attached thereto at each said bottom surface, and said first end of said first support spring is connected to said first plate and said first end of said second support spring is connected to said second plate.

6. The shop press of claim 1, wherein the guide means comprises a first guide means mounted to said first upright frame member and a second guide means mounted to said second upright frame member.

7. The shop press of claim 6, wherein each of said first and second upright frame members has a first side and a second side and wherein each of said first and second guide means includes a first member mounted to the first side of said upright frame member and a second member mounted to the second side of said upright member, and wherein said members engage the respective side surface of the lower support means and the respective first and second upright side members for sliding movement thereof relative to said members when said workrest frame reciprocates.

* * * * *